US005404626A

United States Patent [19]

Bylund et al.

[11] Patent Number: 5,404,626

[45] Date of Patent: Apr. 11, 1995

[54] METHOD AND APPARATUS TO CREATE AN IMPROVED MOIRÉ FABRIC BY UTILIZING PRESSURIZED HEATED GAS

[75] Inventors: Don M. Bylund; Howard C. Willauer, Jr., both of Spartanburg, S.C.

[73] Assignee: Milliken Research Corporation, Spartanburg, S.C.

[21] Appl. No.: 142,575

[22] Filed: Oct. 25, 1993

[51] Int. Cl.[6] ..... D06C 23/04

[52] U.S. Cl. ..... 26/69 R; 28/163; 28/167

[58] Field of Search ..... 26/69 R, 1, 69 A, 69 B; 28/163, 165, 167, 169; 8/114, 114.5, 114.6; 34/629, 638, 646; 68/5 R, 6, 7, 5 D

[56] References Cited

U.S. PATENT DOCUMENTS

| | | | |
|---|---|---|---|
| 1,603,723 | 10/1926 | Stetten . | |
| 1,635,091 | 7/1927 | Lyth | 26/69 R |
| 1,889,902 | 12/1932 | Moore . | |
| 2,083,248 | 6/1937 | Teres | 28/163 |
| 2,110,118 | 3/1938 | Robertson et al. | 26/29 |
| 2,119,057 | 5/1938 | Richa | 222/51 |
| 2,241,222 | 5/1941 | Sonnino | 26/2 |
| 2,448,145 | 8/1948 | Holterhoff | 26/69 R |
| 2,513,646 | 7/1950 | Holterhoff | 26/69 R |
| 2,563,259 | 8/1951 | Miller | 117/9 |
| 2,598,795 | 6/1952 | Holterhoff | 26/106 |
| 2,723,937 | 11/1955 | Rice | 154/106 |
| 2,875,504 | 3/1959 | White | 28/72 |
| 2,988,800 | 6/1961 | White | 28/72 |
| 3,010,179 | 11/1961 | Thal | 28/72 |
| 3,153,106 | 10/1964 | Schlick | 264/78 |
| 3,171,484 | 3/1965 | Thal | 161/63 |
| 3,214,819 | 11/1965 | Guerin | 28/72.2 |
| 3,256,581 | 6/1966 | Thal et al. | 26/2 |
| 3,353,225 | 11/1967 | Dodson, Jr. et al. | 19/161 |
| 3,357,074 | 12/1967 | Allman et al. | 28/1 |
| 3,403,862 | 10/1968 | Dworjanyn | 239/566 |
| 3,434,188 | 3/1969 | Summers | 28/72.2 |
| 3,443,878 | 5/1969 | Weber et al. | 8/14 |
| 3,448,501 | 6/1969 | Buzano | 28/72 |
| 3,452,412 | 7/1969 | Allman, Jr. et al. | 28/72 |
| 3,458,905 | 8/1969 | Dodson, Jr. et al. | 19/161 |
| 3,494,821 | 2/1970 | Evans | 161/169 |
| 3,508,308 | 4/1970 | Bunting, Jr. et al. | 28/72.2 |

(List continued on next page.)

FOREIGN PATENT DOCUMENTS

| | | | |
|---|---|---|---|
| 233019 | 5/1959 | Australia | 264/504 |
| 766310 | 9/1971 | Belgium . | |
| 653805 | 12/1962 | Canada | 28/72 |
| 2056210 | 5/1972 | Germany . | |
| 3613070 | 10/1987 | Germany | D04B 35/34 |
| 352410 | 7/1931 | United Kingdom | 26/69 |
| 851473 | 10/1960 | United Kingdom . | |
| 978452 | 5/1962 | United Kingdom . | |
| 1012963 | 12/1965 | United Kingdom . | |
| 1101899 | 1/1968 | United Kingdom | B26F 1/26 |
| 1171543 | 11/1969 | United Kingdom | B29D 7/22 |
| 1172289 | 11/1969 | United Kingdom | D06C 1/08 |
| 1321236 | 6/1973 | United Kingdom | D06C 7/00 |
| 1353183 | 5/1974 | United Kingdom | D06C 23/04 |
| 2088424 | 6/1982 | United Kingdom | D06C 11/00 |

*Primary Examiner*—Clifford D. Crowder
*Assistant Examiner*—Amy B. Vanatta
*Attorney, Agent, or Firm*—Kevin M. Kercher; Terry T. Moyer

[57] ABSTRACT

An apparatus and method for creation of moiré textile fabric. This can be achieved by directing at least one stream of pressurized heated gas at the surface of said first piece of overfed fabric to provide lateral yarn displacement and selectively interrupting and re-establishing contact between said stream and said surface in accordance with pattern information in order to pattern said first piece of fabric. This is followed by combining said patterned first piece of fabric with an unpatterned second piece of fabric in overlapping relationship and applying pressure by means of calender rolls having smooth surfaces to said combination of said first piece of patterned fabric and said second piece of unpatterned fabric. By using high pressure heated gas and shrinking some of the thermoplastic yarns, there is movement of the filling yarns in the fabric.

43 Claims, 8 Drawing Sheets

U.S. PATENT DOCUMENTS

| | | | |
|---|---|---|---|
| 3,585,098 | 6/1971 | Truscott et al. | 161/63 |
| 3,613,186 | 10/1971 | Mazzone et al. | 26/2 R |
| 3,635,625 | 1/1972 | Voss | 425/135 |
| 3,729,784 | 5/1973 | Mazzone et al. | 26/2 R |
| 3,750,237 | 8/1973 | Kalwaites | 19/161 P |
| 3,768,118 | 10/1973 | Ruffo et al. | 19/156.3 |
| 3,774,272 | 11/1973 | Rubaschek et al. | 26/2 R |
| 3,811,131 | 5/1974 | Gamarra et al. | 2/243 |
| 3,842,468 | 10/1974 | Harrison | 28/2.4 |
| 3,862,291 | 1/1975 | Brandon, Jr. et al. | 264/321 |
| 3,875,975 | 4/1975 | Lee, Jr. | 139/291 |
| 3,880,201 | 4/1975 | Lee, Jr. et al. | 139/302 |
| 3,916,823 | 11/1975 | Halloran | 118/63 |
| 3,969,779 | 7/1976 | Stewart, Jr. | 8/149 |
| 4,002,013 | 1/1977 | Johnson et al. | 57/22 |
| 4,059,880 | 11/1977 | Klein | 29/157 C |
| 4,274,182 | 6/1981 | Greenway | 26/2 R |
| 4,312,293 | 1/1982 | Hakim | 118/697 |
| 4,323,760 | 4/1982 | Greenway et al. | 219/364 |
| 4,332,063 | 6/1982 | Ehrhardt | 26/3 |
| 4,335;178 | 6/1982 | Fearing | 428/253 |
| 4,364,156 | 12/1982 | Greenway et al. | 26/2 R |
| 4,393,562 | 7/1983 | Stokes | 26/2 R |
| 4,418,451 | 12/1983 | Crenshaw | 26/2 R |
| 4,444,831 | 4/1984 | Leitner | 428/262 |
| 4,471,514 | 9/1984 | Stokes | 26/2 R |
| 4,499,637 | 2/1985 | Greenway | 26/2 R |

*FIG. –1–*

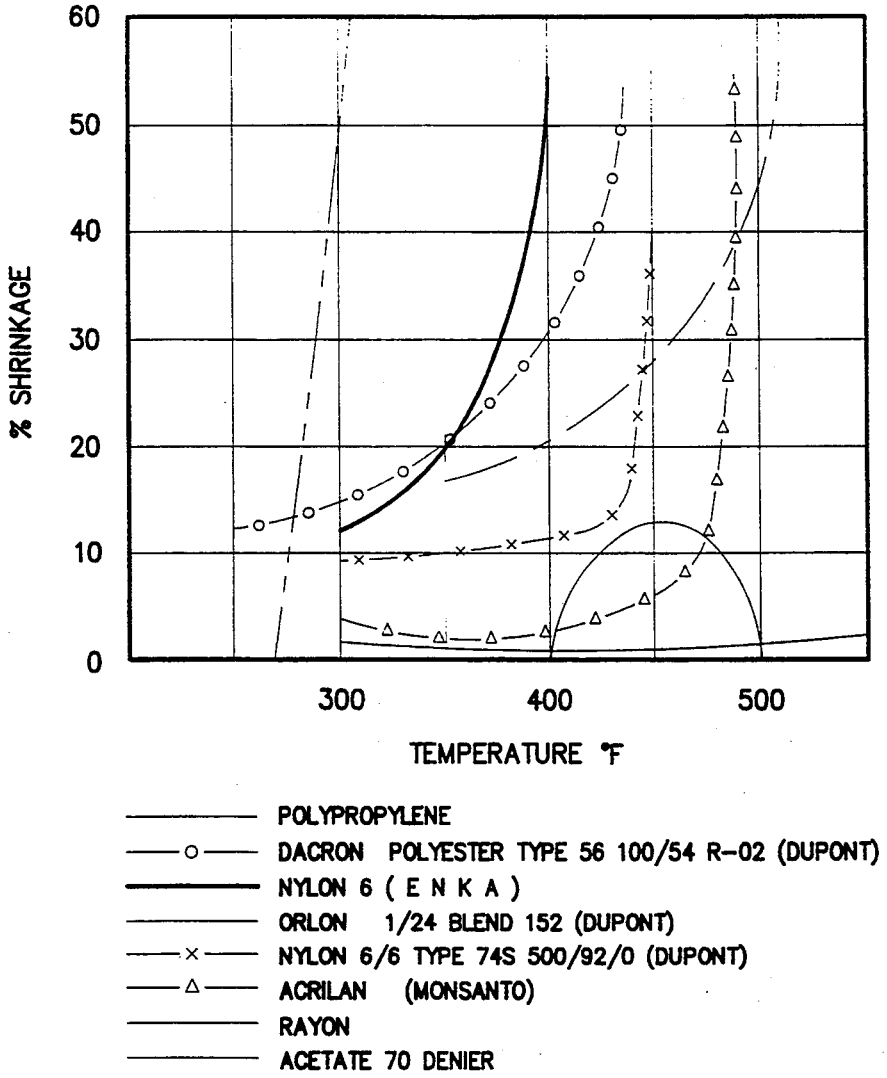
*FIG. —5—*
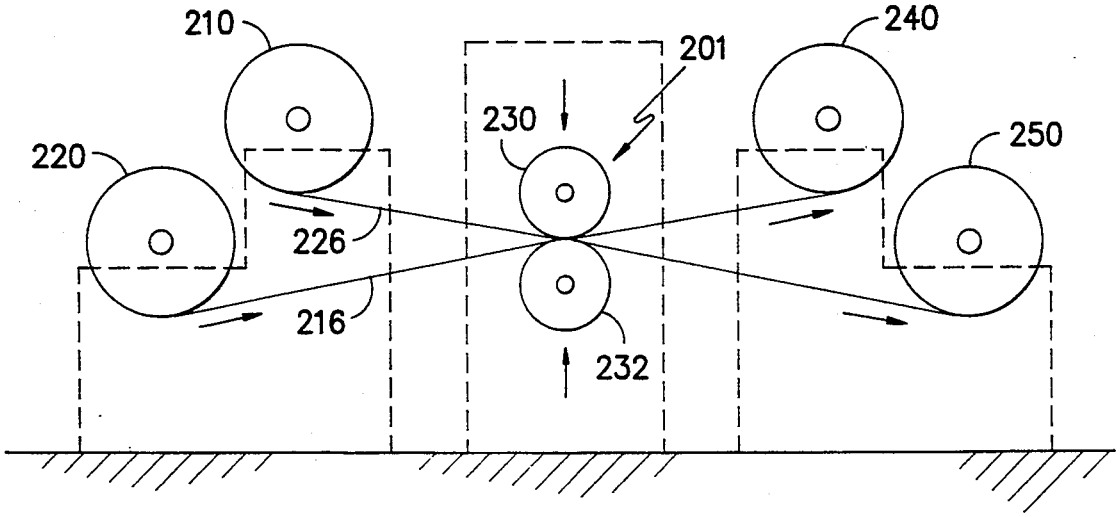
*FIG. —6—*

METHOD AND APPARATUS TO CREATE AN IMPROVED MOIRÉ FABRIC BY UTILIZING PRESSURIZED HEATED GAS

BACKGROUND OF THE INVENTION

This invention relates to a method and apparatus for creation of moiré fabric. Traditional moiré fabrics are defined as a wavy or watered effect on textile fabric, especially a corded fabric of silk, rayon, or one of the manufactured fibers. An excellent example of a corded fabric would be a faille. Failles are generally defined as having fine, bright, continuous filament warps and coarse spun filling and a plain weave. This creates a noticeable ribbed effect in the filling direction. Other fabrics can be utilized with typically lesser results, however, a visible ribbed effect should be present in the fabric's filling.

Moiré fabric falls into one of two categories. The first is an uncontrolled moiré when the filling ribs of one layer of fabric are intentionally skewed with respect to the second layer of fabric prior to applying pressure to both layers of fabric. This will result in a significant increase in the number of filling ribs that cross with the associated increase in vertical moiré lines. This is very undesirable since the appearance of the moiré fabric will never be consistent and will vary from batch to batch. Traditionally, controlled moiré fabric is formed by selectively distorting or skewing small portions of the filling ribs so that the filling ribs only cross in selective areas. The most common method is the Francais bar method in which ribbed woven fabric is dragged over a stationary bar which has a series of knobs which are spaced at desired intervals. This is done at very high tension. The knobs distort the filling into a bow wherever they touch the fabric. When two pieces of this fabric are subjected to pressure, a traditional controlled moiré will result that is typically found in upholstery, drapery, apparel, and other end uses. Problems with this type of moiré patterning include the fact that the pattern is repeatedly fixed and dragging under high tension can damage and/or destroy the fabric.

Another traditional method utilized in creating controlled moiré fabric is the "scratch" method. This is accomplished by means of a resilient roll having the desired designs embossed thereon. These designs may include flowers, geometrics, and so forth. While the fabric is in contact with this embossed roll, it is "scratched" with a series of steel blades which distort the filling yarns of the fabric according to the pattern that is embossed on the roll. Upon applying pressure to two pieces of this treated fabric, a moiré pattern is produced. Again, there is the problem of the destruction or damage to the yarns by the steel blades and a fixedly repeatable pattern. This "scratch" method produces very poor results with a large quantity of broken filaments. The blades actually only contact the warp yarns thus producing a large amount of broken filaments with only minimal movement of the filling yarn. It is the movement of the filling yarn that is the desired result. Furthermore, by examination of faille fabric, the filling is virtually covered by warp yarns and thus it is very difficult to move the filling by mechanical means. Also, this "scratch" method creates fuzz on the surface of the fabric that results in less shine and poor moiré patterns.

Yet another traditional method of producing a controlled moiré is by that found in U.S. Pat. No. 2,448,145, which discloses the selective application of water to fabric with a noticeable ribbed effect in the filling direction. The fabric is then placed under high tension and then dried. This will distort the filling yarns in the wet areas differently than the filling yarns in the dry areas. Again, upon applying pressure to two pieces of this treated fabric, a moiré pattern is produced. A severe problem with this technology is that it would be very difficult to wet yarns selectively while leaving adjacent yarns dry for a very precise pattern. Furthermore, stretching under high tension can severely weaken or even destroy filling yarns. Furthermore, this method is deficient in that it only works on fibers that absorb large amounts of water such as cotton, silk and so forth. Each pattern requires a specific patterning roll or screen which only changes the pick count slightly in the areas treated with water. While this may produce some beating when the fabrics are sandwiched and calendered, it does not produce true moiré because the filling is not distorted with bow or skew.

The present invention solves these problems in a manner not disclosed in the known prior art.

SUMMARY OF THE INVENTION

An apparatus and method for creation of moiré fabric by directing at least one stream of pressurized heated gas at the surface of said first piece of overfed fabric to provide lateral yarn displacement and selectively interrupting and re-establishing contact between said stream and said surface in accordance with pattern information in order to pattern said first piece of fabric. This is followed by combining said patterned first piece of fabric with an unpatterned second piece of fabric in overlapping relationship and applying pressure by means of calender rolls having smooth surfaces to said combination of said first piece of patterned fabric and said second piece of unpatterned fabric. By using high pressure heated gas and shrinking some of the thermoplastic yarns, there is movement of the filling yarns in the fabric.

An advantage of this invention is to have moiré patterns of any length or, in other words, patterns that do not necessarily repeat.

Still another advantage of this invention is the means of patterning is relatively nondestructive with overfed fabric.

Another advantage of this invention is extremely precise since the amount of shrinking of thermoplastic fibers can be exactly controlled.

A further advantage of this invention is that patterning can be extremely complex with the only limits being those of the human imagination.

Another advantage of this invention is that patterning can be altered while the machine is processing and downloaded in real time with the only limit being that of the complexity of the available computer system utilized in the storage and retrieval of moiré patterns.

Yet another advantage of this invention is that the fill yarns can be shifted up to five-eighths of an inch.

In another advantage of this invention is that a perfect fill yarn shift sine wave can be created by contrasting treated portions of textile fabric with untreated portions of textile fabric.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which:

FIG. 5 is a graph comparing percentage of shrinkage as a function of temperature for a number of fiber types;

FIG. 6 is a diagrammatic side view of two supply rolls, two calendering rolls and two take-up rolls;

DETAILED DESCRIPTION OF THE PREFERRED EMBODIMENT

Figure 1:
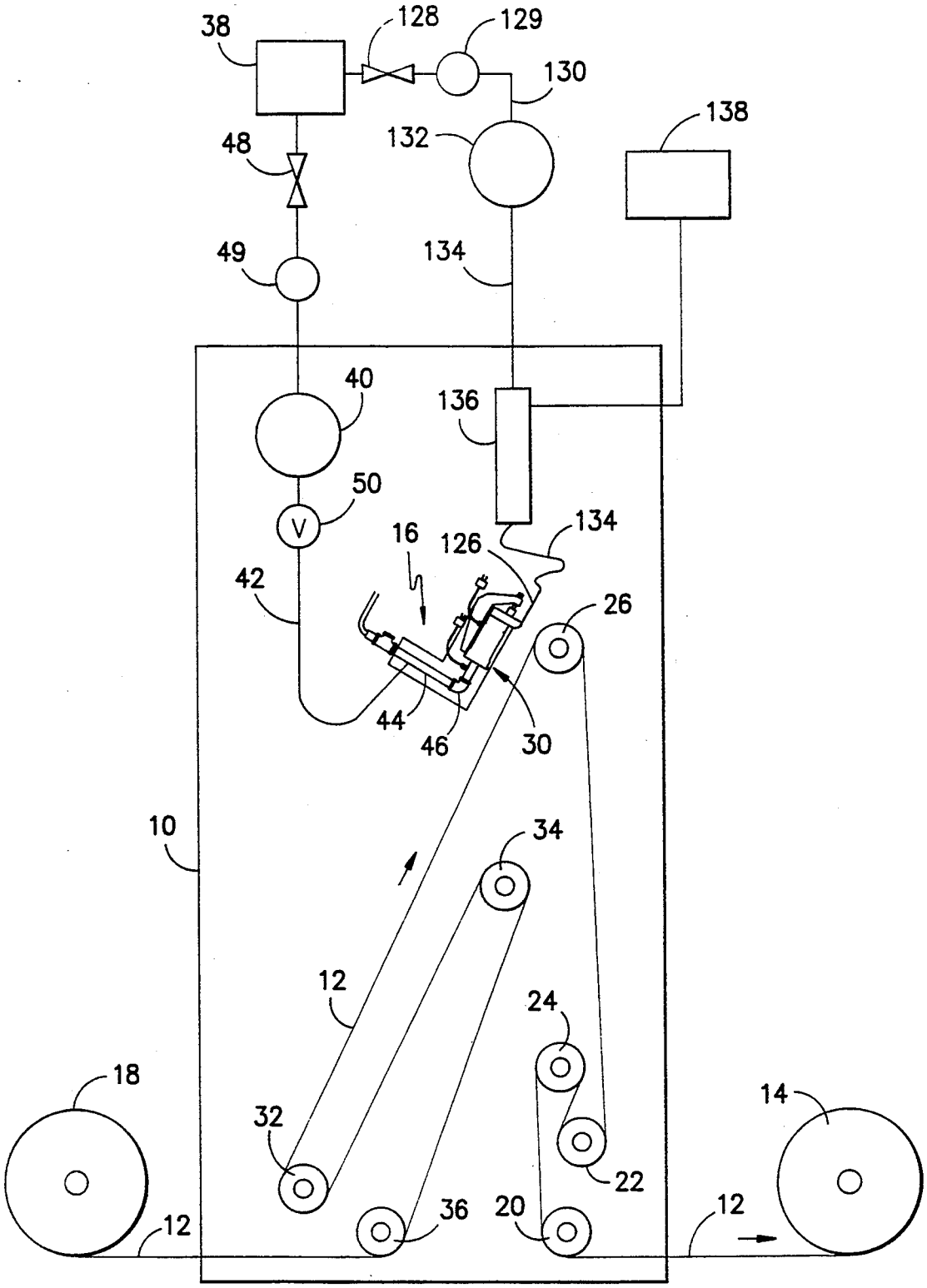
FIG. 1 is a schematic side elevation view of apparatus for heated pressurized fluid stream treatment of a moving textile fabric to impart a surface pattern or change in the surface appearance thereof, and incorporating novel features of the present invention.

Referring now to the accompanying drawings, and initially to FIG. 1, which shows, diagrammatically, an overall side elevational view of apparatus for heated pressurized gas stream treatment of a textile fabric to impart lateral yarn displacement. As seen, the apparatus includes a main support frame including end frame support members, one of which 10 is illustrated in FIG. 1. Suitably rotatably mounted on the end support members of the frame are a plurality of textile fabric guide rolls which direct an indefinite length of textile fabric 12, from a fabric supply roll 18, past a pressurized heated gas treating unit, generally indicated at 16. After treatment, the textile fabric is collected in a continuous manner on a take-up roll 14. As shown, textile fabric 12 from supply roll 18 passes over an idler roll 36 and is fed by a pair of driven rolls 34, 32 to a main driven textile fabric support roll 26 with the textile fabric 12 between drive roll 32 and textile fabric support roll 26 being overfed and slack in a range of between two and twenty percent with a preferred range of between two and twelve percent. The amount of overfeed depends on the construction, weave tightness, fiber type, and other factors related to the textile fabric 12. The overfeed must stop before the point at which puckering of the textile fabric 12 occurs. The surface of the textile fabric passes closely adjacent to the heated fluid discharge outlet of an elongate fluid distributing manifold assembly 30 of treating unit 16. The treated textile fabric 12 thereafter passes over a series of driven guide rolls 22, 24 and an idler roll 20 to take-up roll 14 for collection.

As illustrated in FIG. 1, fluid treating unit 16 includes a source of compressed gas, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of heated fluid distributing manifold assembly 30 and supply heated pressurized air thereto through short, individual air supply lines, indicated at 46, which communicate with assembly 30 uniformly along its full length. Air supplied to the heated fluid distributing manifold assembly 30 is controlled by a master control valve 48, pressure regulator valve 49, and individual precision control valves, such as needle valves 50, located in each heater air supply line 42. The heaters 44 are controlled in suitable manner, as by temperature sensing means located in the outlet lines 46 of each heater, with regulation of air flow and electrical power to each of the heaters to maintain the heated fluid at a uniform temperature and pressure as it passes into the manifold assembly along its full length.

Typically, for patterning textile fabrics, such as pile fabrics containing thermoplastic yarns, the heaters are employed to heat air exiting the heaters and entering the manifold assembly to a uniform temperature of about 700° F.–750° F. However, the range of temperature for fabric treated with this apparatus may be between about 500° F. to about 1200° F. or more. The preferred operating temperature for any given textile fabric depends upon: the components of the textile fabric, the construction of the textile fabric, the desired effect, the speed of transport of the textile fabric, the pressure of the heated pressurized gas, the tension of the textile fabric, the proximity of the textile fabric to the treating manifold, and others.

The heated fluid distributing manifold assembly 30 is disposed across the full width of the path of movement of the textile fabric and closely adjacent the surface thereof to be treated. Although the length of the manifold assembly may vary, typically in the treatment of textile fabric materials, the length of the manifold assembly may be 76 inches or more to accommodate textile fabrics of up to about 72 inches in width.

Figure 2:
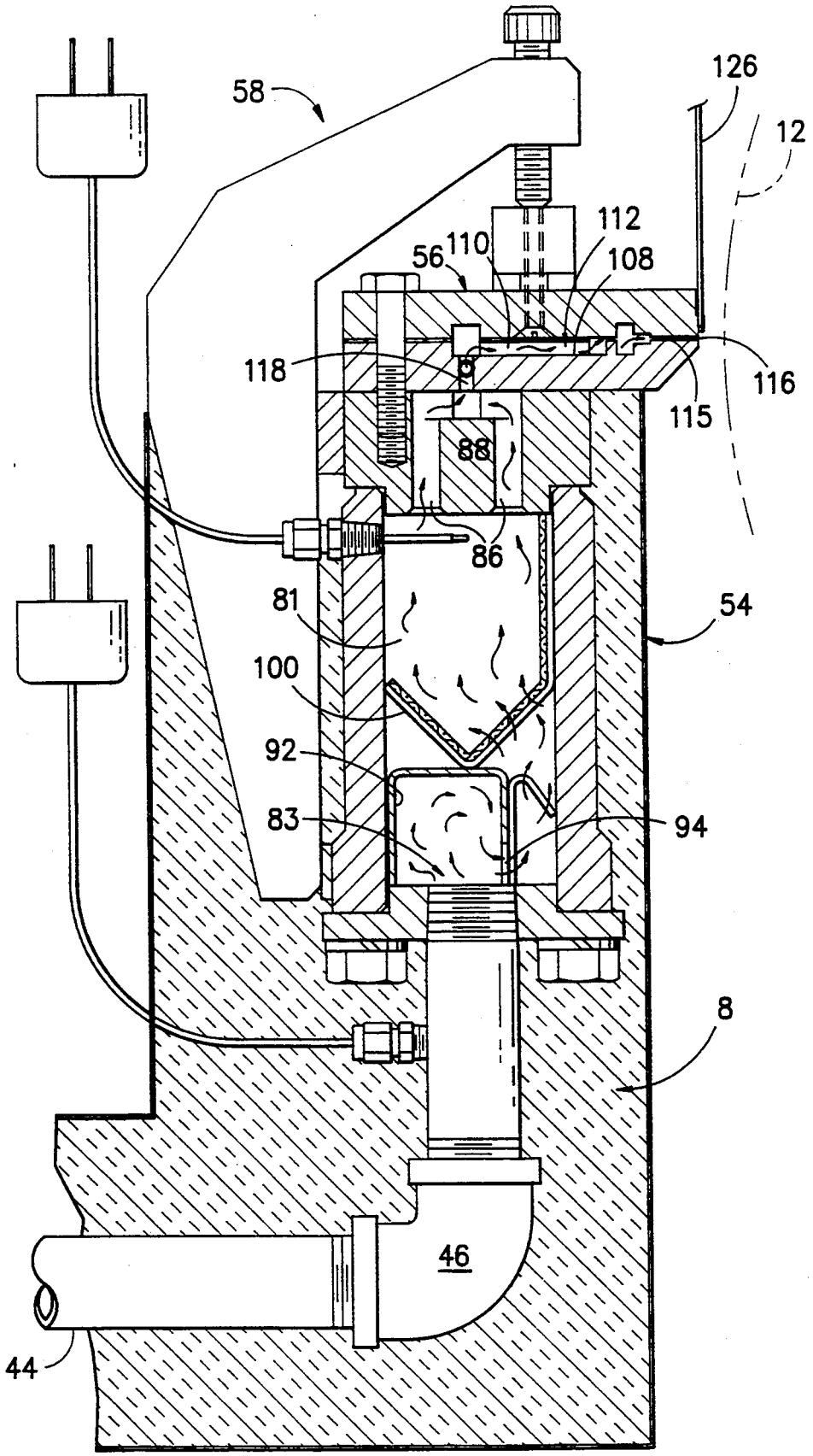
FIG. 2 is an enlarged partial sectional elevation view of the fluid distributing manifold assembly of the apparatus of FIG. 1.

Details of the heated fluid distributing manifold assembly 30 may be best described by reference to FIGS. 2–3 of the Drawings. As seen in FIG. 2, which is a partial sectional elevation view through the assembly, there is a first large elongate manifold housing 54 and a second smaller elongate manifold housing 56 secured in fluid tight relationship therewith by a plurality of spaced clamping means, one of which is generally indicated at 58. The manifold housings 54, 56 extend across the full width of the textile fabric 12 adjacent its path of movement.

As best seen in FIG. 2, first elongate manifold housing 54 is of generally rectangular cross-sectional shape, and includes a first elongate gas receiving compartment 81, the ends of which are sealed by end wall plates suitably bolted thereto. Communicating with bottom wall plate through fluid inlet openings, one of which, 83, is shown in FIG. 2, and spaced approximately uniformly therealong are the air supply lines 46 from each of the electrical heaters 44.

The manifold housings 54, 56 are constructed and arranged so that the flow path of gas through the first housing 54 is generally at a right angle to the discharge axes of the gas stream outlets of the second manifold housing 56.

Figure 3:
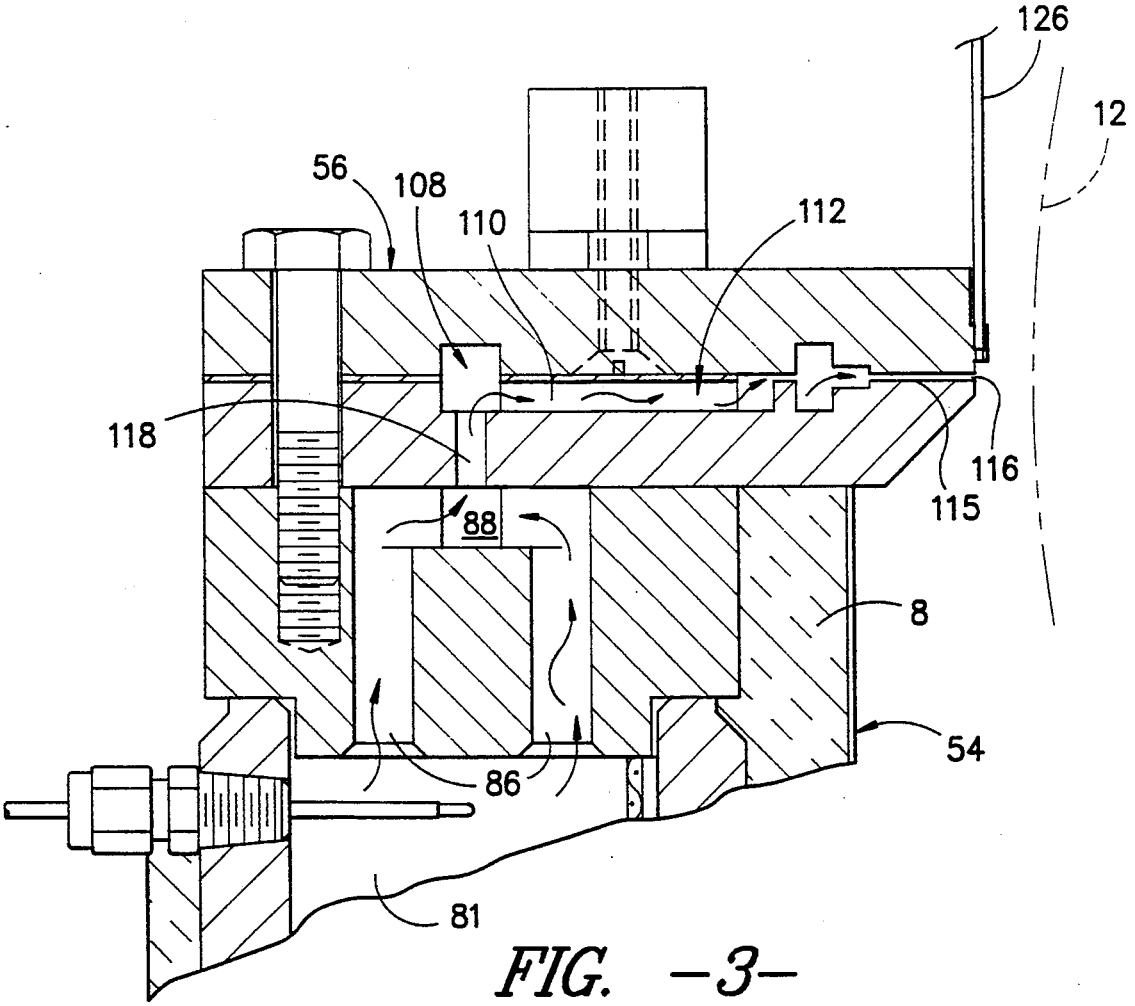
FIG. 3 is an enlarged broken away sectional view of the fluid stream distributing manifold housing of the manifold assembly as illustrated in FIG. 2.

As best seen in FIGS. 2 and 3, manifold housing 54 is provided with a plurality of gas flow passageways 86 which are disposed in uniformly spaced relation along the plate in two rows to connect the first gas receiving compartment 81 with a central elongate channel 88.

Baffle plate 92 serves to define a gas receiving chamber in the compartment 81 having side openings or slots 94 to direct the incoming heated air from the bank of heaters in a generally reversing path of flow through compartment 81. Disposed above channel-shaped baffle plate 92 is compartment 81 between the fluid inlet openings 83 and fluid outlet passageways 86 is an elongate filter member 100 which is a generally J-shaped plate with a filter screen disposed thereabout.

Figure 4:
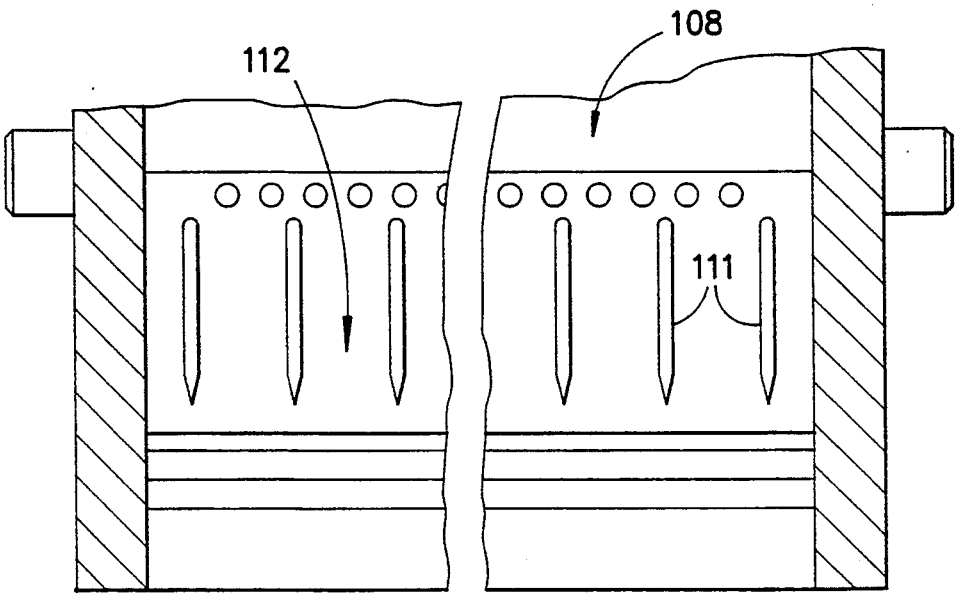
FIG. 4 is an enlarged broken away sectional view of an end portion of the fluid stream distributing manifold housing.

As seen in FIGS. 2, 3 and 4, a second smaller manifold housing 56 comprises first and second opposed elongate wall members, each of which has an elongate recess or channel 108 therein. Wall members are disposed in spaced, coextensive parallel relation with their recesses 108 in facing relation to form upper and lower wall portions of a second gas receiving compartment 110, in the second manifold housing 56. The gas then passes through a third gas receiving compartment 112 in the lower wall member of manifold housing 56 which is defined by small elongate islands 111 approximately uniformly spaced along the length of the member, as shown in FIG. 4. A continuous slit directs heated pressurized air from the third gas receiving compartment 112 in a continuous sheet across the width of the fabric at a substantially right angle onto the surface of the moving textile fabric 12. Typically, in the treatment of textile fabrics such as pile fabrics containing thermoplastic pile yarn or fiber components with a flat woven textile fabric containing thermoplastic or fiber yarn, the continuous slit 115 of manifold 56 may be 0.015 to about 0.030 of an inch in thickness. For precise control of the heated air streams striking the fabric, the continuous slit is preferably maintained between about 0.070 to 0.080 of an inch from the fabric surface being treated. However, this distance from the face of the fabric can be as much as 0.100 of an inch and still produce good pattern definition. The deflecting air tubes are spaced 20 to the inch over the 72 inch air distributing manifold, although apparatus has been constructed as coarse as 10 to the inch and as fine as 44 to the inch.

Second manifold housing 56 is provided with a plurality of spaced gas inlet openings 118 (FIGS. 2 and 3) which communicate with the elongate channel 88 of the first manifold housing 54 along its length to receive pressurized heated air from the first manifold housing 54 into the second gas receiving compartment 110.

The continuous slit 115 of the second manifold housing 56 which directs a stream of air into the surface of textile fabric 12 is provided with tubes 126 which communicate at a right angle to the discharge axis of continuous slit 115 to introduce pressurized cool air, i.e., air having a temperature substantially below that of the heated air in third gas receiving compartment 112, at the heated gas discharge outlet 116 to deflect selectively the flow of heated air through the continuous slit 115 in accordance with pattern control information. Air passing through the tubes 126 may be cooled by a water jacket which is provided with cooling water from a suitable source, not shown, although such cooling is not required.

As seen in FIG. 1, pressurized unheated air is supplied to each of the tubes 126 from compressor 38 by way of a master control valve 128, pressure regulator valve 129, air line 130, and unheated air header pipe 132 which is connected by a plurality of individual air supply lines 134 to the individual tubes 126. Each of the individual cool air supply lines 134 is provided with an individual control valve located in a valve box 136. These individual control valves are operated to open or close in response to signals from a pattern control device, such as a computer 138, to deflect the flow of hot air through continuous slit 115 during movement of the fabric and thereby produce a desired pattern in the fabric. Detailed patterning information for individual patterns may be stored and accessed by means of any known data storage medium suitable for use with electronic computers, such as magnetic tape, EPROMs, etc. The foregoing details of the construction and operation of the manifold assembly 30 of the gas treating apparatus are the subject matter of commonly assigned U.S. Pat. No. 4,471,514 entitled "Apparatus for Imparting Visual Surface Effects to Relatively Moving Materials" and issued on Sep. 18, 1984. The disclosure thereof is included herein by reference for full description and clear understanding of the improved features of the present invention.

Each cool air fluid tube 126 is positioned at approximately a right angle to the plane defined by slit 115 to deflect heated pressurized air away from the surface of the moving fabric 12 (FIG. 3) as the textile fabric approaches continuous slit 115. This deflection is generally at about a 45 degree angle from the path defined by continuous slit 115, and serves to direct the deflected heated air toward the oncoming textile fabric 12. Thus, a strong blast of mixed hot and cold air strikes the surface of the textile fabric prior to its being subjected to the action of the heated air issuing from continuous slit 115.

This configuration of tubes 126 provides sufficient volume of air in combination with that from the continuous slit 115 to preheat textile fabric 12 to a temperature preferably short of permanent thermal modification.

It should be noted that, due to the insulation 8 generally surrounding manifold 54, preheating is not believed to be the result of heat radiation from the manifold, but is rather the result of the exposure of textile fabric 12 to the heated air issuing from continuous slit 115, as that air is diverted by the relatively cool air issuing from tubes 126. The heated air used for this purpose is air that has been diverted, in accordance with patterning instructions, after issuing from continuous slit 115, i.e., this air would be diverted whether or not pre-heating was desired. Therefore, preheating of the textile fabric is achieved as an integral part of, and is inseparable from, the patterning process, and requires no additional or separate heated air source. By so doing, not only is a separate preheating step and its attendant complexity unnecessary, but it is believed a separate preheating step would be incapable of imparting heat of sufficient intensity and directivity to maintain the textile fabric 12 at an effective preheated temperature at the instant the heated patterning air issuing from continuous slit 115 contacts the textile fabric, as shown in FIG. 4.

This preheating may cause additional thermal modification during the patterning step. As can be seen in connection with FIG. 5, the amount of shrinkage is a function of the type of fiber involved and the temperature to which it is subjected. The temperature of the hot air is adjusted to accommodate a particular fiber so that the amount of shrinkage can be controlled regardless of the fabric.

Additional information relating to the operation of such a pressurized heated gas apparatus, including more detailed description of patterning and control functions, can be found in coassigned U.S. Pat. No. 5,035,031, that issued on Jul. 30, 1991, which is incorporated by reference as if fully set forth herein and coassigned U.S. Pat. No. 5,148,583, that issued on Sep. 22, 1992, which is incorporated by reference as if fully set forth herein and coassigned U.S. Pat. No. 4,393,562, that issued on Jul. 19, 1983, which is incorporated by reference as if fully set forth herein and coassigned U.S. Pat. No. 4,364,156, that issued on Dec. 21, 1982, which is incorporated by reference as if fully set forth herein and coassigned U.S. Pat. No. 4,418,451, that issued on Dec. 6, 1982, which is incorporated by reference as if fully set forth herein.

Figure 13:
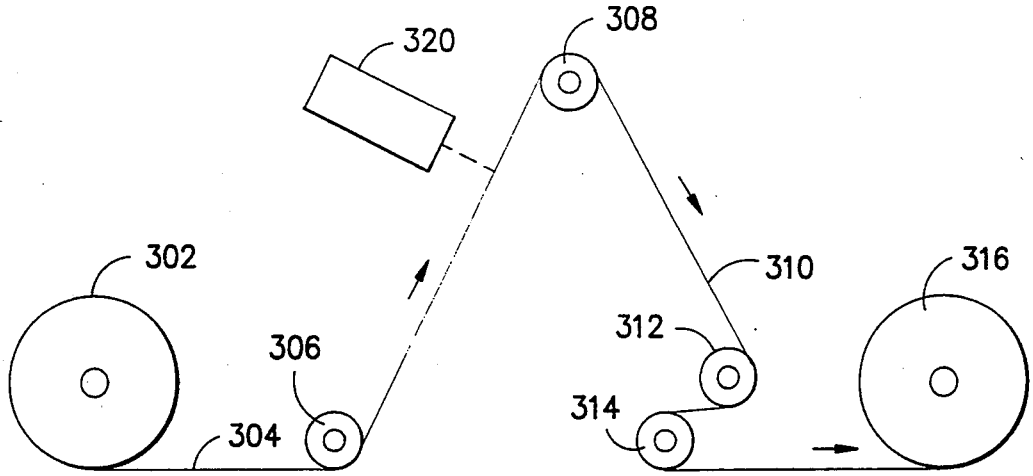
FIG. 13 is a schematic side elevation view of apparatus for laser beam treatment of a moving textile fabric to impart a surface pattern or change in the surface appearance thereof, and incorporating novel features of the present invention.

In the alternative, another means of achieving lateral yarn displacement, although not the preferred means, is to subject textile fabric to the heat of a laser. Referring now to FIG. 13, which shows, diagrammatically, an overall side elevational view of apparatus for laser treatment of a textile fabric to impart lateral yarn displacement. There is a plurality of textile fabric guide rolls which direct an indefinite length of textile fabric 304, from a fabric supply roll 302, past a laser unit, which is indicated by numeral 320. After treatment, the textile fabric 304 is collected in a continuous manner on a take-up roll 316. As shown, textile fabric 304 from supply roll 302 passes over an idler roll 306 to a main driven textile fabric support roll 308. The surface of the textile fabric 304 is hit by the laser beam from laser unit 320 between idler roll 306 and driven textile fabric support roll 308. The treated textile fabric 304 thereafter passes over a series of driven guide rolls 312, 314 and to take-up roll 316 for collection.

Laser unit 320 is preferable a 10.6 micron wavelength, eighty watt, carbon dioxide laser, although any of a wide variety of lasers will suffice. One typical laser of this type is manufactured by Laser Machining, Inc. that is located at 500 Laser Drive, MS 628, Industrial Park, Somerset, Wis. 54025. Although not specifically limited thereto, the preferred range of moving the textile fabric 304 is a speed of one hundred to two hundred inches per minute.

Referring now to FIG. 6, the next step in the process is to take the patterned textile fabric 216 and have this patterned fabric processed by a calender mechanism that is generally indicated by numeral 201. The patterned textile fabric 216 is placed on supply roll 220 and an unpatterned textile fabric 226 is placed on supply roll 210. Both the patterned textile fabric 216 and unpatterned textile fabric 226 are fed into an upper calendering roll 230 and lower calendering roll 232. For good patterning, both the patterned textile fabric 216 and unpatterned textile fabric 226 should be ribbed since the surface of the upper calendering roll 230 is smooth as well as the surface of lower calendering roll 232. The moiré pattern is made by placing these two layers of ribbed textile fabric 216 and 226 on top of each other so that the ribs of the upper unpatterned textile fabric 226 are slightly off-grain in relation to the lower patterned textile fabric 216. These true moiré patterns are produced when the upper unpatterned textile fabric 226 is sandwiched with the lower patterned textile fabric 216 and passed through the calender rolls 230 and 232 at high pressure so that wherever the filling yarns cross, a moiré pattern is produced. The unpatterned textile fabric 226 may be the lower fabric with the patterned textile fabric 216 being the upper textile fabric with no consequential difference. A pressure of 300 to 10,000 pounds per linear inch of fabric between the upper calendering roll 230 and lower calendering roll 232 on the textile fabrics 216 and 226 causes the ribbed pattern of the patterned textile fabric 216 to be pressed into the unpatterned textile fabric 226 and visa-versa. Pressure requirements for producing moiré depend on the speed of traverse, temperature, moisture, and types of calender rolls utilized. A typical range for temperature would be between 100 and 450 degrees Fahrenheit. A typical range for moisture would be between 30 and 100 percent relative humidity for natural fibers. Artificial fibers are typically unaffected by relative humidity. The speed of traverse is typically between 10 and 100 feet per minute.

Flattened areas in the ribs reflect more light and create a contrast to unflattened areas. The patterned textile fabric 216 and unpatterned textile fabric 226 are then received by take-up rolls 250 and 240, respectively. The crushed and uncrushed portions of either textile fabric 216 or fabric 226 causes a difference in light reflectance. This creates a wavy or watery effect in both textile fabrics 216 and 226, respectively. In this case, both textile fabrics 26 and 226 will have the same moiré pattern but they will be mirror images. This technique is especially useful when geometric or floral patterns are used. If both textile fabrics 216, 226 are patterned, they would be very difficult to keep in register. The method of treating textile fabric 12 with pressurized heated gas can result in a shift in the fill yarn of up to five-eighths of an inch depending on the fabric fiber, construction, weave, and so forth.

Beat repeat patterns may be introduced by having the pick count different in the two layers of textile fabric 216 and 226 that are sandwiched together. This may be accomplished by weaving two different pick counts. Another way to accomplish this is to place tension on one of the layers which will reduce the pick count slightly to produce a beating. "Beating" is defined as the pattern developed due to superimposed waves of different frequencies.

Textile fabric 226 does not have to be unpatterned and may also be patterned with a different pattern than patterned textile fabric 216. Also, either textile fabric 216 or 226 may have a different pick count to produce a beating pattern. With this embodiment, the preferred material for the upper calendering roll 230 is a metal such as steel and the preferred material for the lower calendering roll 232 is a composite fiber.

Figure 14:
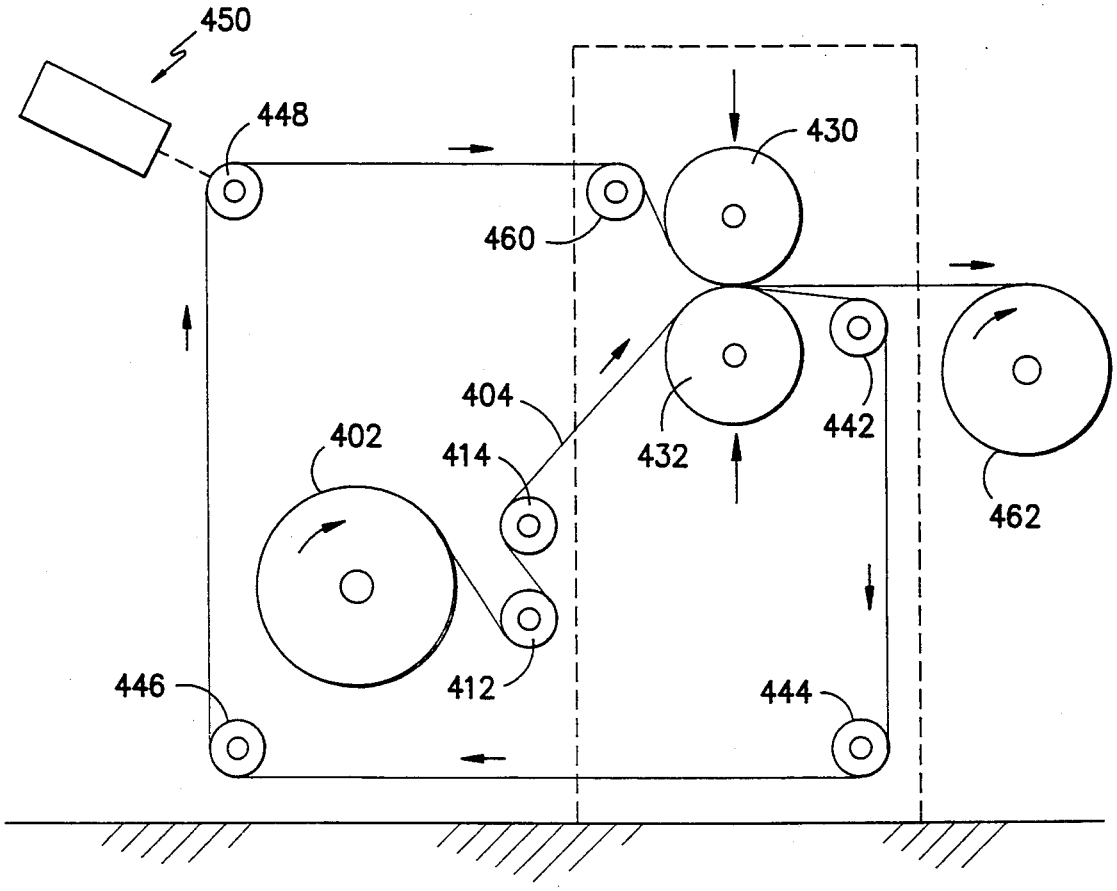
FIG. 14 is a diagrammatic side view of a preferred chase-calendering system having a supply roll, two calendering rolls and a take-up roll in which treated fabric is pressed against untreated fabric by the calendering rolls.

The preferred means of calendering is to utilize a chase-type calendering system such as that disclosed in FIG. 14 as opposed to that disclosed in FIG. 6. There is a plurality of textile fabric guide rolls which direct an indefinite length of textile fabric 404, from a fabric supply roll 402, over a series of driven guide rolls 412, 414 and then through calender roll 432. Calender roll 432 is equivalent to calender roll 232 disclosed in FIG. 6. The textile fabric 404 is then fed by a series of driven rolls 442, 4444, and 446 to a main driven textile fabric support roll 448. The surface of the textile fabric passes closely adjacent to the treating unit 450 which may be either a hot gas unit designated in FIG. 1 by numeral 16 or a laser unit designated in FIG. 13 by numeral 320. After treatment, the textile fabric 404 goes around idler roll 460 and then through upper calendering roll 430, which is equivalent to upper calendering roll 230 found in FIG. 6. The moiré patterns are produced when the upper treated textile fabric 404 is sandwiched with same lower untreated textile fabric 404 and passed through the calender rolls 430 and 432 at high pressure so that wherever the filling yarns cross, a moiré pattern is produced. A pressure of 300 to 10,000 pounds per linear inch of fabric between the upper calendering roll 430 and lower calendering roll 432 on the textile fabric 404 causes a ribbed pattern to be created. A pattern does not appear on the untreated textile fabric 404 due to the fact that the lower calender roll 432 is air cooled so the temperature does not typically exceed 120 degrees Fahrenheit. The speed of traverse is typically between 10 and 100 feet per minute. The textile fabric 404 is then collected in a continuous manner on a take-up roll 462. With this preferred embodiment, the preferred material for the upper calendering roll 230 is a metal such as steel and the preferred material for the lower calendering roll 232 is a lightweight polymer, such as nylon. A typical calendar of this type is manufactured by Ramtsch Kleinewefers Kalander GmbH in 1975 located at 415 Krefeld, Postfach 2350, Germany.

Other methods of applying pressure include high pressure rotary presses and platen presses. Some very beautiful textile fabrics are produced by creating the moiré fabric and then printing the textile fabric with a colorant such as a dye or pigment. The fabric may, also, be printed first and then patterned by pressurized heated gas and then calendered under pressure to produce a different effect. It may also be patterned by pressurized gas, printed and then calendered to produce a novel textile fabric. Any type of textile fabric printing may be used including but not limited to rotary screen, flat bed, air brush or engraved roll.

Most fiber types will work with this invention including, but not limited to, polyester, polyamide, acetate, rayon, cotton, and so forth. This invention is not restricted to plain weaves but most woven fabrics will work including, but not limited to, dobby and jacquard woven fabrics. Woven fabrics have warp yarns extending in the warp direction and fill yarns extending in the fill direction. For best results, the fill yarns should have a ribbed effect. Furthermore, this invention is not restricted to woven fabrics since a moiré pattern can be applied to warp knit fabrics. Warp knit fabrics have wales which are a column of loops lying lengthwise in the fabric and correspond to the warp in woven fabrics. Also, warp knit fabrics have courses which are a row of loops or stitches running across a knit fabric corresponding to filing in woven fabrics.

If approximately fifty percent of the textile fabric is treated by pressurized heated gas and fifty percent of the textile fabric is not treated by pressurized heated gas, then a shift in the fill yarn will be in the form of a sine wave.

The following examples demonstrate, without intending to be limiting in any way, the method by which fabrics of the present invention have been generated.

EXAMPLE 1

An apparatus similar to that schematically depicted in FIGS. 1–4 and 6 was used, in accordance with the following specifications.

Figure 7:
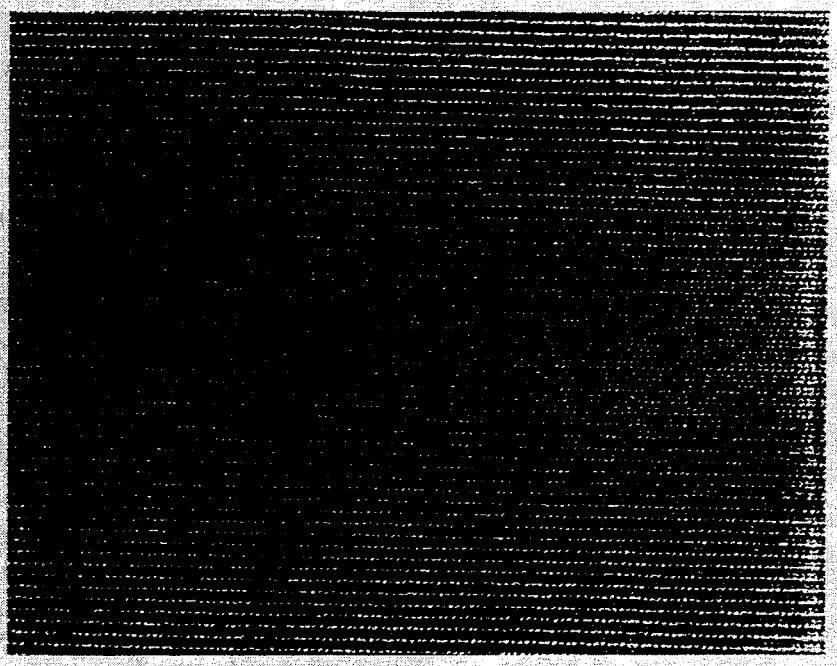
FIG. 7 is a photomicrograph (1.1×) of the face of the untreated textile fabric of Example 1.

Fabric: a faille fabric having a warp comprised of 132 ends/inch of 73.23 denier bright polyester continuous filament and a fill comprised of 7.95 denier spun polyester and a pick count of 33. The faille fabric has been woven, prepared, dyed and heat-set and has a weight of 5.16 ounces per square yard. A photomicrograph of this fabric is shown by FIG. 7 at 1.1 magnification.

This fabric was then patterned with vertical bands utilizing a continuous slit hot air nozzle.

Fluid: hot air, at a pressure of 3.2 p.s.i.g.

Pattern gauge: 20 lines per inch.

Source of pattern data: Floppy disk, with appropriate associated electronics of conventional design.

Roll: solid, smooth stainless steel, rotating at a circumference speed of 9 yards per minute in the same direction as warp yarns in fabric.

Figure 8:
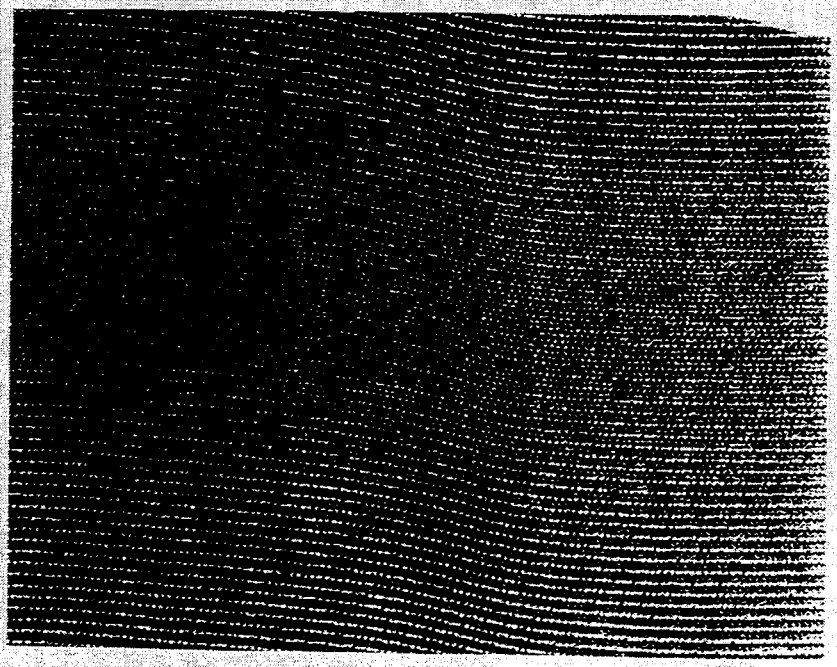
FIG. 8 is a photomicrograph (1.1×) of the face of the textile fabric of Example 1 after the step of selectively patterning the fabric by means of high pressure streams of heated gas.

In this Example, the entire fabric surface was treated in a series of vertical bands. The yarns have been thermally modified by shrinkage where the streams have impacted the fabric. A photomicrograph of this treated fabric is shown by FIG. 8 at 1.1 magnification.

Figure 9:
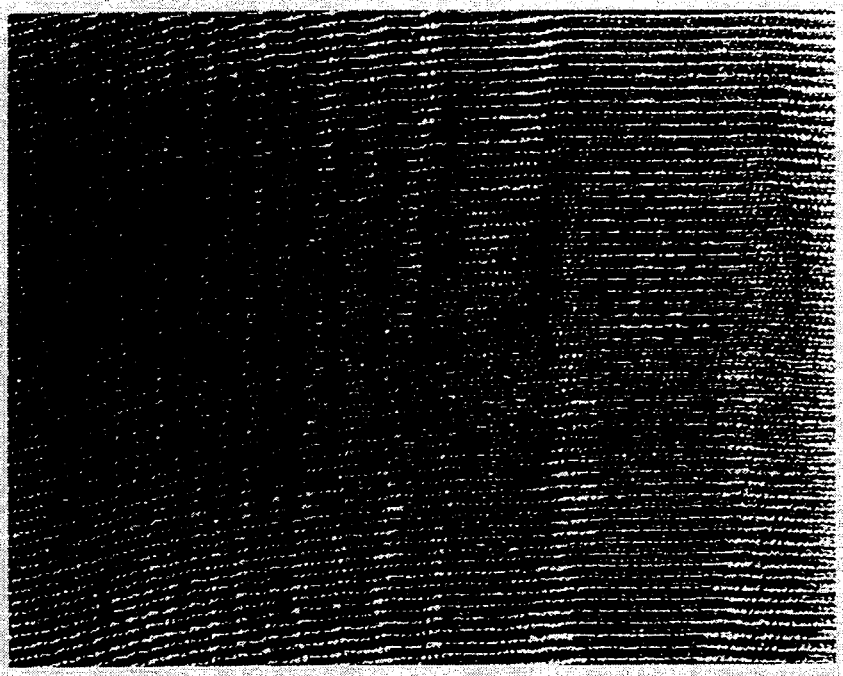
FIG. 9 is a photomicrograph (1.1×) of the face of the textile fabric of Example 1 after the step of selectively patterning the fabric by means of high pressure streams of heated gas and the step of calendering under one ton of pressure per linear inch with a second layer of the untreated fabric of FIG. 7.

This patterned fabric was then sandwiched with an unpatterned piece of the same fabric and run through a BRIEM® calender at eight yards a minute with a temperature of three-hundred and eighty degrees Fahrenheit on the steel roll with a pressure of one ton per linear inch. The upper roll is made of steel and the lower roll is made of a composite fiber with heat transferred between both rolls. BRIEM® calenders were formerly manufactured by Ernest L. Frank Associates, Inc., 515 Madison Avenue, New York, N.Y. 10022, who is no longer in existence. Both pieces of fabric display the moiré pattern shown by the photomicrograph of FIG. 9 at 1.1 magnification.

EXAMPLE 2

An apparatus similar to that schematically depicted in FIGS. 1–4 and 6 was used, in accordance with the following specifications.

Figure 10:
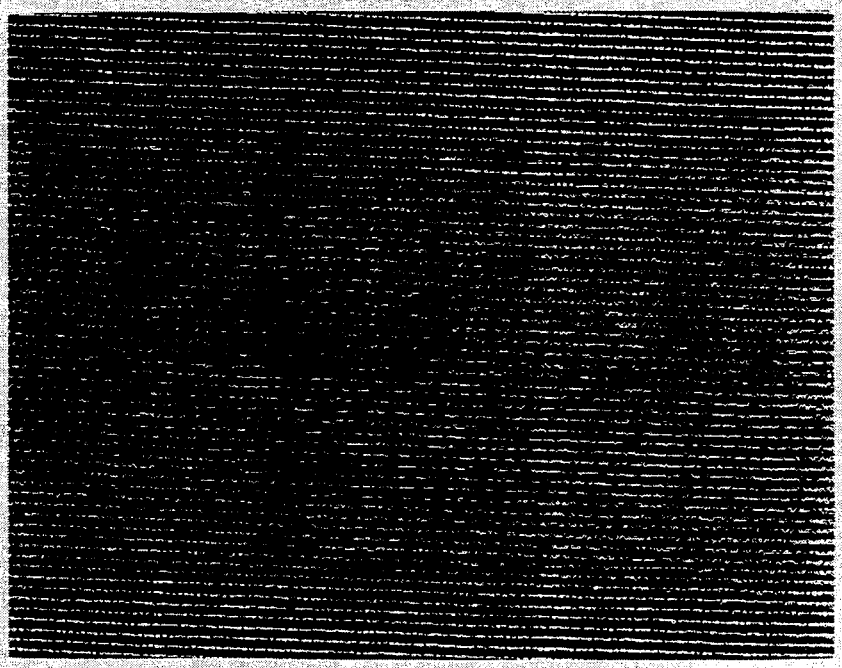
FIG. 10 is a photomicrograph (1.1×) of the face of the untreated textile fabric of Example 2.

Fabric: a faille fabric having a warp comprised of 106 ends/inch of 152.36 denier bright polyester continuous filament and a fill comprised of 13.24 denier spun polyester and a pick count of 31. The faille fabric has been woven, prepared, dyed and heat-set and has a weight of 5.88 ounces per square yard. A photomicrograph of this fabric is shown by FIG. 10 at 1.1 magnification.

This fabric was then patterned with vertical bands with a continuous slit hot air nozzle.

Fluid: hot air, at a pressure of 3.2 p.s.i.g.
Pattern gauge: 20 lines per inch.
Source of pattern data: Floppy disk, with appropriate associated electronics of conventional design.
Roll: solid, smooth stainless steel, rotating at a circumference speed of 9 yards per minute in the same direction as warp yarns in fabric.

Figure 11:
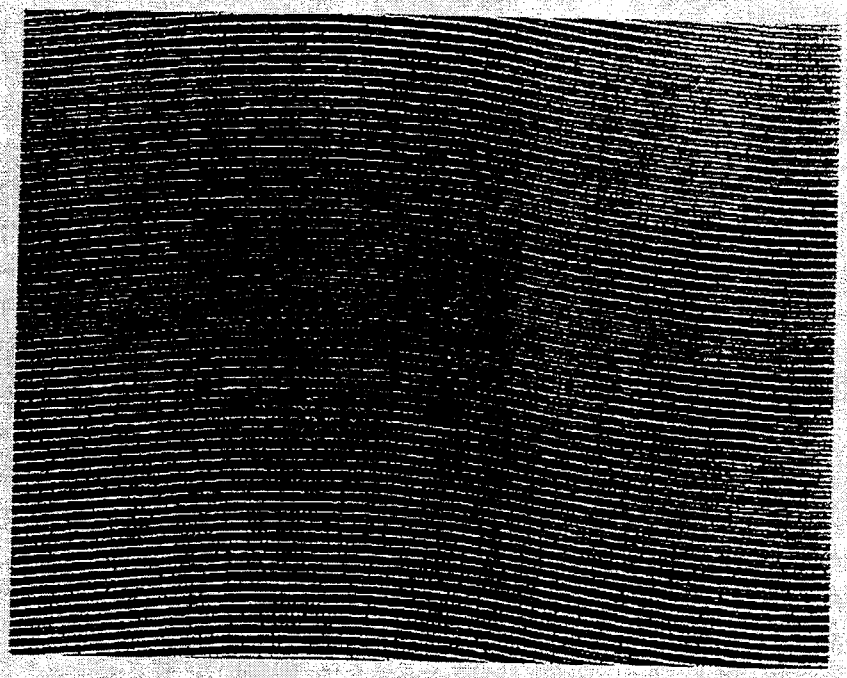
FIG. 11 is a photomicrograph (1.1×) of the face of the textile fabric of Example 2 after the step of selectively patterning the fabric by means of high pressure streams of heated gas.
Figure 12:
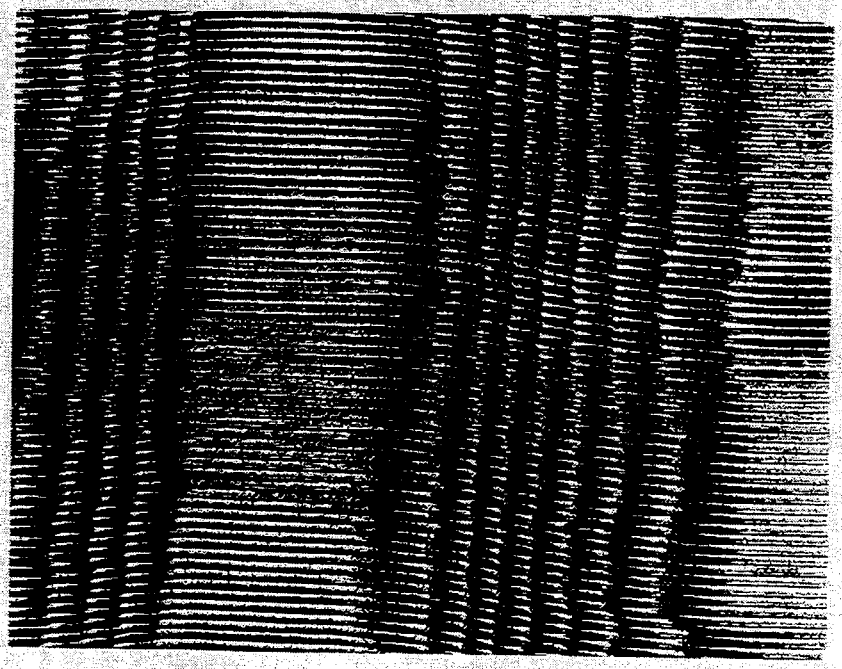
FIG. 12 is a photomicrograph (1.1×) of the face of the textile fabric of Example 2 after the step of selectively patterning the fabric by means of high pressure streams of heated gas and the step of calendering under one ton of pressure per linear inch with a second layer of the untreated fabric of FIG. 10.

In this Example, the entire fabric surface was treated in a series of vertical bands. The yarns have been thermally modified by shrinkage where the streams have impacted the fabric. A photomicrograph of this treated fabric is shown by FIG. 11 at 1.1 magnification. This patterned fabric was then sandwiched with an unpatterned piece of the same fabric and run through a BRIEM® calender at eight yards a minute with a temperature of three-hundred and eighty degrees Fahrenheit on the steel roll with a pressure of one ton per linear inch. The upper roll is made of steel and the lower roll is made of a composite fiber with heat transferred between both rolls. Both pieces of fabric display the moiré pattern shown by the photomicrograph of FIG. 12 at 1.1 magnification.

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

What is claimed is:

1. A process of creating a moiré pattern on textile fabric comprising the steps of:

(a) directing at least one stream of pressurized heated gas at the surface of a first piece of textile fabric, overfed in a range of two to twenty percent, to provide lateral yarn displacement;

(b) selectively interrupting and re-establishing contact between said stream and said surface in accordance with pattern information in order to pattern said first piece of textile fabric;

(c) combining said patterned first piece of textile fabric with a second piece of said textile fabric in overlapping relationship; and (d) applying pressure in a range of between 300 to 10,000 pounds per linear inch to said combination of said first piece of patterned textile fabric and said second piece of textile fabric.

2. A process of creating a moiré pattern on textile fabric as recited in claim 1, further comprising a step of heating said combination of said first piece of patterned textile fabric and said second piece of textile fabric at a temperature in a range of 100 to 450 degrees Fahrenheit substantially simultaneously with said step of applying pressure.

3. A process of creating a moiré pattern on textile fabric as recited in claim 1, further comprising a step of printing on said first piece of patterned textile fabric with a colorant and printing on said second piece of textile fabric with a colorant following said step of applying pressure.

4. A process of creating a moiré pattern on textile fabric as recited in claim 1, further comprising a step of printing on said first piece of patterned textile fabric with a colorant and printing on said second piece of textile fabric with a colorant following said step of directing at least one stream of pressurized heated gas at the surface of said first piece of textile fabric, overfed in a range of two to twenty percent, to provide lateral yarn displacement.

5. A process of creating a moiré pattern on textile fabric comprising the steps of:

(a) directing at least one stream of pressurized heated gas at the surface of a first piece of textile fabric, overfed in a range of two to twenty percent, to provide lateral yarn displacement;

(b) selectively interrupting and re-establishing contact between said stream and said surface in accordance with pattern information in order to pattern said first piece of textile fabric;

(c) directing at least one stream of pressurized heated gas at the surface of a second piece of textile fabric, overfed in a range of two to twenty percent, to provide lateral yarn displacement;

(d) selectively interrupting and re-establishing contact between said stream and said surface in accordance with pattern information in order to pattern said second piece of textile fabric;

(e) combining said patterned first piece of textile fabric with said patterned second piece of textile fabric in overlapping relationship; and (f) applying pressure in a range of between 300 to 10,000 pounds per linear inch to said combination of said first piece of patterned textile fabric and said second piece of patterned textile fabric.

6. A process of creating a moiré pattern on textile fabric comprising the steps of:

(a) printing a first piece of said textile fabric with a colorant;

(b) printing a second piece of said textile fabric with a colorant;

(c) directing at least one stream of pressurized heated gas at the surface of a first piece of textile fabric, overfed in a range of two to twenty percent, to provide lateral yarn displacement;

(d) selectively interrupting and re-establishing contact between said stream and said surface in accordance with pattern information in order to pattern said first piece of textile fabric;

(e) combining said patterned first piece of textile fabric with said second piece of textile fabric in overlapping relationship; and (f) applying pressure in a range of between 300 to 10,000 pounds per linear inch to said combination of said first piece of patterned textile fabric and said second piece of textile fabric.

7. A process of creating a moiré pattern on woven textile fabric having warp yarns extending in the warp direction and fill yarns extending in the fill direction and said fill yarns having a ribbed effect comprising the steps of:

(a) directing at least one stream of pressurized heated gas at the surface of a first piece of woven textile fabric, overfed in a range of two to twenty percent, having a first pick count, to provide lateral yarn displacement;

(b) selectively interrupting and re-establishing contact between said stream and said surface in accordance with pattern information in order to pattern said first piece of woven textile fabric;

(c) combining said patterned first piece of woven textile fabric with a second piece of said woven textile fabric, having a second different pick count, in overlapping relationship; and (d) applying pressure in a range of between 300 to 10,000 pounds per linear inch to said combination of said first piece of patterned woven textile fabric and said second piece of woven textile fabric.

8. A process of creating a moiré pattern on woven textile fabric having warp yarns extending in the warp direction and fill yarns extending in the fill direction and said fill yarns having a ribbed effect comprising the steps of:

(a) directing at least one stream of pressurized heated gas at the surface of a first piece of woven textile fabric, overfed in a range of two to twenty percent, having a first pick count, to provide lateral yarn displacement;

(b) selectively interrupting and re-establishing contact between said stream and said surface in accordance with pattern information in order to pattern said first piece of woven textile fabric;

(c) directing at least one stream of pressurized heated gas at the surface of a second piece of woven textile fabric, overfed in a range of two to twenty percent, having a second pick count, to provide lateral yarn displacement;

(d) selectively interrupting and re-establishing contact between said stream and said surface in accordance with pattern information in order to pattern said second piece of woven textile fabric;

(e) combining said patterned first piece of woven textile fabric with said second piece of said woven textile fabric, in overlapping relationship; and (f) applying pressure in a range of between 300 to 10,000 pounds per linear inch to said combination of said first piece of patterned woven textile fabric and said second piece of woven textile fabric.

9. A process of creating a moiré pattern on endless webs of textile fabric comprising the steps of:

(a) directing at least one stream of pressurized heated gas at the surface of a first endless web of woven textile fabric, overfed in the range of two to twenty percent, to provide lateral yarn displacement;

(b) selectively interrupting and re-establishing contact between said stream and said surface in accordance with pattern information in order to pattern said first endless web of textile fabric;

(c) combining said patterned first endless web of said textile fabric with a second endless web of said textile fabric in overlapping relationship; and (d) applying pressure in a range of between 300 to 10,000 pounds per linear inch to said combination of said first endless web of patterned textile fabric and said second endless web of textile fabric.

10. A process of creating a moiré pattern on textile fabric as recited in claim 9, further comprising a step of heating said combination of said first endless web of patterned textile fabric and said second endless web of textile fabric at a temperature in a range of 100 to 450 degrees Fahrenheit substantially simultaneously with said step of applying pressure.

11. A process of creating a moiré pattern on endless webs of textile fabric as recited in claim 9, further comprising a step of printing on said first endless web of patterned textile fabric with a colorant and printing on said second endless web of textile fabric with a colorant following said step of applying pressure.

12. A process of creating a moiré pattern on endless webs of textile fabric as recited in claim 9, further comprising a step of printing on said first endless web of patterned textile fabric with a colorant and printing on said second endless web of textile fabric with a colorant following said step of directing at least one stream of gas at the surface of said first endless web of textile fabric, overfed in a range of two to twenty percent, to provide lateral yarn displacement.

13. A process of creating a moiré pattern on endless webs of textile fabric comprising the steps of:

(a) directing at least one stream of pressurized heated gas at the surface of a first endless web of textile fabric, overfed in a range of two to twenty percent, to provide lateral yarn displacement;

(b) selectively interrupting and re-establishing contact between said stream and said surface in accordance with pattern information in order to pattern said first endless web of textile fabric;

(c) directing at least one stream of pressurized heated gas at the surface of a second endless web of textile fabric, overfed in the range of two to twenty percent, to provide lateral yarn displacement;

(d) selectively interrupting and re-establishing contact between said stream and said surface in accordance with pattern information in order to pattern said second endless web of textile fabric;

(e) combining said patterned first endless web of said textile fabric with said patterned second endless web of said textile fabric in overlapping relationship; and (f) applying pressure in a range of between 300 to 10,000 pounds per linear inch to said combination of said first endless web of patterned textile fabric and said second endless web of patterned textile fabric.

14. A process of creating a moiré pattern on endless webs of textile fabric comprising the steps of:

(a) printing a first endless web of textile fabric with a colorant;

(b) printing a second endless web of textile fabric with a colorant; G (c) directing at least one stream of gas at the surface of said first endless web of said textile fabric, overfed in a range of two to twenty percent, to provide lateral yarn displacement;

(d) delivering said stream at a peak dynamic pressure in excess of about 300 p.s.i.g. and less than 4,000 p.s.i.g.;

(e) selectively interrupting and re-establishing contact between said stream and said surface in accordance with pattern information in order to pattern said first endless web of textile fabric;

(f) combining said patterned first endless web of said textile fabric with a second endless web of said textile fabric in overlapping relationship; and (g) applying pressure in a range of between 300 to 10,000 pounds per linear inch to said combination of said first endless web of patterned textile fabric and said second endless web of textile fabric.

15. A process of creating a moiré pattern on endless webs of woven textile fabric having warp yarns extending in the warp direction and fill yarns extending in the fill direction and said fill yarns having a ribbed effect comprising the steps of:

(a) directing at least one stream of gas at the surface of a first endless web of said woven textile fabric, overfed in a range of two to twenty percent, having a first pick count, to provide lateral yarn displacement;

(b) selectively interrupting and re-establishing contact between said stream and said surface in accordance with pattern information in order to pattern said first endless web of woven textile fabric;

(c) combining said patterned first endless web of said woven textile fabric with a second endless web of said woven textile fabric, having a second different pick count, in overlapping relationship; and (d) applying pressure in a range of between 300 to 10,000 pounds per linear inch to said combination of said first endless web of patterned woven textile fabric and said second endless web of woven textile fabric.

16. A process of creating a moiré pattern on endless webs of woven textile fabric having warp yarns extending in the warp direction and fill yarns extending in the fill direction and said fill yarns having a ribbed effect comprising the steps of:

(a) directing at least one stream of gas at the surface of a first endless web of said woven textile fabric, overfed in a range of two to twenty percent, having a first pick count, to provide lateral yarn displacement;

(b) selectively interrupting and re-establishing contact between said stream and said surface in accordance with pattern information in order to pattern said first endless web of woven textile fabric;

(c) directing at least one stream of gas at the surface of a second endless web of said woven textile fabric, overfed in a range of two to twenty percent, having a second pick count, to provide lateral yarn displacement;

(d) selectively interrupting and re-establishing contact between said stream and said surface in accordance with pattern information in order to pattern said second endless web of woven textile fabric;

(e) combining said patterned first endless web of said woven textile fabric with said second endless web of said woven textile fabric, having a second different pick count, in overlapping relationship; and (f) applying pressure in a range of between 300 to 10,000 pounds per linear inch to said combination of said first endless web of patterned woven textile fabric and said second endless web of woven textile fabric.

17. A system for creating a moiré pattern on textile fabric comprising the steps of:

(a) a means for directing at least one stream of pressurized heated gas at the surface of a first piece of textile fabric, overfed in a range of two to twenty percent, to provide lateral yarn displacement;

(b) a means for selectively interrupting and re-establishing contact between said stream and said surface in accordance with pattern information in order to pattern said first piece of textile fabric;

(c) a means for combining said patterned first piece of textile fabric with a second piece of said textile fabric in overlapping relationship; and (d) a means for applying pressure in a range of between 300 to 10,000 pounds per linear inch to said combination of said first piece of patterned textile fabric and said second piece of textile fabric.

18. A system for creating a moiré pattern on textile fabric as recited in claim 17, wherein said means for applying pressure includes a pair of calender rolls.

19. A system for creating a moiré pattern on textile fabric as recited in claim 17, wherein said means for applying pressure includes a high pressure rotary press.

20. A system for creating a moiré pattern on textile fabric as recited in claim 17, wherein said means for applying pressure includes a high pressure platen press.

21. A system for creating a moiré pattern on textile fabric as recited in claim 17, further comprising a means for printing said first piece of textile fabric with a colorant and a means for printing said second piece of textile fabric with a colorant.

22. A system for creating a moiré pattern on textile fabric as recited in claim 17, further comprising a means for heating said combination of said first piece of patterned textile fabric and said second piece of textile fabric at a temperature in a range of 100 to 450 degrees Fahrenheit.

23. A system for creating a moiré pattern on textile fabric comprising the steps of:

(a) a means for directing at least one stream of pressurized heated gas at the surface of a first piece of textile fabric, overfed in a range of two to twenty percent, to provide lateral yarn displacement;

(b) a means for selectively interrupting and re-establishing contact between said stream and said surface in accordance with pattern information in order to pattern said first piece of textile fabric;

(c) a means for directing at least one stream of pressurized heated gas at the surface of a second piece of textile fabric, overfed in a range of two to twenty percent, to provide lateral yarn displacement;

(d) a means for selectively interrupting and re-establishing contact between said stream and said surface in accordance with pattern information in order to pattern said second piece of textile fabric;

(e) a means for combining said patterned first piece of textile fabric with said patterned second piece of textile fabric in overlapping relationship; and (f) a means for applying pressure in a range of between 300 to 10,000 pounds per linear inch to said combination of said first piece of patterned textile fabric and said second piece of patterned textile fabric.

24. A system for creating a moiré pattern on endless webs of textile fabric comprising the steps of:

(a) a means for directing at least one stream of pressurized heated gas at the surface of a first endless web of woven textile fabric, overfed in a range of two to twenty percent, to provide lateral yarn displacement;

(b) a means for selectively interrupting and re-establishing contact between said stream and said surface in accordance with pattern information in order to pattern said first endless web of textile fabric;

(c) a means for combining said patterned first endless web of said textile fabric with a second endless web of said textile fabric in overlapping relationship; and (d) a means for applying pressure in a range of between 300 to 10,000 pounds per linear inch to said combination of said first endless web of patterned textile fabric and said second endless web of textile fabric.

25. A system for creating a moiré pattern on textile fabric as recited in claim 24, wherein said means for applying pressure includes a pair of calender rolls.

26. A system for creating a moiré pattern on textile fabric as recited in claim 24, wherein said means for applying pressure includes a high pressure rotary press.

27. A system for creating a moiré pattern on textile fabric as recited in claim 24, wherein said means for applying pressure includes a high pressure platen press.

28. A system for creating a moiré pattern on textile fabric as recited in claim 24, further comprising a means for printing said first endless web of textile fabric with a colorant and a means for printing said second endless web of textile fabric with a colorant.

29. A system for creating a moiré pattern on textile fabric as recited in claim 24, further comprising a means for heating said combination of said first endless web of patterned textile fabric and said second endless web of textile fabric at a temperature in a range of 100 to 450 degrees Fahrenheit.

30. A system for creating a moiré pattern on endless webs of textile fabric comprising the steps of:

(a) a means for directing at least one stream of pressurized heated gas at the surface of a first endless web of textile fabric, overfed in a range of two to twenty percent, to provide lateral yarn displacement;

(b) a means for selectively interrupting and re-establishing contact between said stream and said surface in accordance with pattern information in order to pattern said first endless web of textile fabric;

(c) a means for directing at least one stream of pressurized heated gas at the surface of a second endless web of textile fabric, overfed in a range of two to twenty percent, to provide lateral yarn displacement;

(d) a means for selectively interrupting and re-establishing contact between said stream and said surface in accordance with pattern information in order to pattern said second endless web of textile fabric;

(e) a means for combining said patterned first endless web of said textile fabric with said patterned second endless web of said textile fabric in overlapping relationship; and (f) a means for applying pressure in a range of between 300 to 10,000 pounds per linear inch to said combination of said first endless web of patterned textile fabric and said second endless web of patterned textile fabric.

31. A system for creating a moiré pattern on textile fabric as recited in claim 30, wherein said means for applying pressure includes a pair of calender rolls.

32. A system for creating a moiré pattern on textile fabric as recited in claim 30, wherein said means for applying pressure includes a high pressure rotary press.

33. A system for creating a moiré pattern on textile fabric as recited in claim 30, wherein said means for applying pressure includes a high pressure platen press.

34. A system for creating a moiré pattern on textile fabric as recited in claim 30, further comprising a means for printing said first endless web of textile fabric with a colorant and a means for printing said second endless web of textile fabric with a colorant.

35. A system for creating a moiré pattern on textile fabric as recited in claim 30, further comprising a means for heating said combination of said first endless web of patterned textile fabric and said second endless web of textile fabric at a temperature in a range of 100 to 450 degrees Fahrenheit.

36. A process of creating a moiré pattern on textile fabric comprising the steps of:

(a) directing at least one laser beam at a surface of a first piece of textile fabric to provide lateral yarn displacement;

(b) selectively interrupting and re-establishing contact between said laser beam and said surface in accordance with pattern information in order to pattern said first piece of textile fabric;

(c) combining said patterned first piece of textile fabric with a second piece of said textile fabric in overlapping relationship; and (d) applying pressure in a range of between 300 to 10,000 pounds per linear inch to said combination of said first piece of patterned textile fabric and said second piece of textile fabric.

37. A process of creating a moiré pattern on textile fabric comprising the steps of:

(a) directing at least one laser beam at the surface of a first piece of textile fabric, to provide lateral yarn displacement;

(b) selectively interrupting and re-establishing contact between said laser beam and said surface in accordance with pattern information in order to pattern said first piece of textile fabric;

(c) directing at least one laser beam at a surface of a second piece of textile fabric, to provide lateral yarn displacement;

(d) selectively interrupting and re-establishing contact between said laser beam and said surface in accordance with pattern information in order to pattern said second piece of textile fabric;

(e) combining said patterned first piece of textile fabric with said patterned second piece of textile fabric in overlapping relationship; and (f) applying pressure in a range of between 300 to 10,000 pounds per linear inch to said combination of said first piece of patterned textile fabric and said second piece of patterned textile fabric.

38. A process of creating a moiré pattern on endless webs of textile fabric comprising the steps of:

(a) directing at least one laser beam at a surface of a first endless web of woven textile fabric, to provide lateral yarn displacement;

(b) selectively interrupting and re-establishing contact between said laser beam and said surface in accordance with pattern information in order to pattern said first endless web of textile fabric;

(c) combining said patterned first endless web of said textile fabric with a second endless web of said textile fabric in overlapping relationship; and (d) applying pressure in a range of between 300 to 10,000 pounds per linear inch to said combination of said first endless web of patterned textile fabric and said second endless web of textile fabric.

39. A process of creating a moiré pattern on endless webs of textile fabric comprising the steps of:

(a) directing at least one laser beam at a surface of a first endless web of textile fabric to provide lateral yarn displacement;

(b) selectively interrupting and re-establishing contact between said laser beam and said surface in accordance with pattern information in order to pattern said first endless web of textile fabric;

(c) directing at least one laser beam at a surface of a second endless web of textile fabric to provide lateral yarn displacement;

(d) selectively interrupting and re-establishing contact between said stream and said surface in accordance with pattern information in order to pattern said second endless web of textile fabric;

(e) combining said patterned first endless web of said textile fabric with said patterned second endless web of said textile fabric in overlapping relationship; and (f) applying pressure in a range of between 300 to 10,000 pounds per linear inch to said combination of said first endless web of patterned textile fabric and said second endless web of patterned textile fabric.

40. A system for creating a moiré pattern on textile fabric comprising the steps of:

(a) a means for directing at least one laser beam at a surface of a first piece of textile fabric to provide lateral yarn displacement;

(b) a means for selectively interrupting and re-establishing contact between said laser beam and said surface in accordance with pattern information in order to pattern said first piece of textile fabric;

(c) a means for combining said patterned first piece of textile fabric with a second piece of said textile fabric in overlapping relationship; and (d) a means for applying pressure in a range of between 300 to 10,000 pounds per linear inch to said combination of said first piece of patterned textile fabric and said second piece of textile fabric.

41. A system for creating a moiré pattern on textile fabric comprising the steps of:

(a) a means for directing at least one laser beam at a surface of a first piece of textile fabric, to provide lateral yarn displacement;

(b) a means for selectively interrupting and re-establishing contact between said laser beam and said surface in accordance with pattern information in order to pattern said first piece of textile fabric;

(c) a means for directing at least one laser beam at a surface of a second piece of textile fabric, to provide lateral yarn displacement;

(d) a means for selectively interrupting and re-establishing contact between said laser beam and said surface in accordance with pattern information in order to pattern said second piece of textile fabric;

(e) a means for combining said patterned first piece of textile fabric with said patterned second piece of textile fabric in overlapping relationship; and (f) a means for applying pressure in a range of between 300 to 10,000 pounds per linear inch to said combination of said first piece of patterned textile fabric and said second piece of patterned textile fabric.

42. A system for creating a moiré pattern on endless webs of textile fabric comprising the steps of:

(a) a means for directing at least one laser beam at a surface of a first endless web of woven textile fabric to provide lateral yarn displacement;

(b) a means for selectively interrupting and re-establishing contact between said laser beam and said surface in accordance with pattern information in order to pattern said first endless web of textile fabric;

(c) a means for combining said patterned first endless web of said textile fabric with a second endless web of said textile fabric in overlapping relationship; and (d) a means for applying pressure in a range of between 300 to 10,000 pounds per linear inch to said combination of said first endless web of patterned textile fabric and said second endless web of textile fabric.

43. A system for creating a moiré pattern on endless webs of textile fabric comprising the steps of:

(a) a means for directing at least one laser beam at a surface of a first endless web of textile fabric, to provide lateral yarn displacement;

(b) a means for selectively interrupting and re-establishing contact between said laser beam and said surface in accordance with pattern information in order to pattern said first endless web of textile fabric;

(c) a means for directing at least one laser beam at a surface of a second endless web of textile fabric, to provide lateral yarn displacement;

(d) a means for selectively interrupting and re-establishing contact between said laser beam and said surface in accordance with pattern information in order to pattern said second endless web of textile fabric;

(e) a means for combining said patterned first endless web of said textile fabric with said patterned second endless web of said textile fabric in overlapping relationship; and (f) a means for applying pressure in a range of between 300 to 10,000 pounds per linear inch to said combination of said first endless web of patterned textile fabric and said second endless web of patterned textile fabric.

* * * * *